US006286502B1

(12) United States Patent
Moberg

(10) Patent No.: US 6,286,502 B1
(45) Date of Patent: Sep. 11, 2001

(54) FIREPLACE ASSEMBLY

(76) Inventor: Walter Moberg, 5735 SE. Lincoln St., Portland, OR (US) 97520

( * ) Notice: Subject to any disclaimer, the term of this patent is extended or adjusted under 35 U.S.C. 154(b) by 0 days.

(21) Appl. No.: 09/518,769

(22) Filed: Mar. 3, 2000

(51) Int. Cl.[7] ..... F24B 1/18
(52) U.S. Cl. ..... 126/500; 126/515; 126/536
(58) Field of Search ..... 126/500, 515, 126/531–539, 77, 66, 65, 307 R, 242, 285 R, 318

(56) References Cited

U.S. PATENT DOCUMENTS

| | | | | |
|---|---|---|---|---|
| 1,708,790 | | 4/1929 | Hall . | |
| 1,755,771 | | 4/1930 | Chambers . | |
| 2,752,691 | | 7/1956 | Bender . | |
| 3,228,387 | | 1/1966 | Milan . | |
| 3,420,020 | | 1/1969 | Keppelman . | |
| 4,117,827 | * | 10/1978 | Billmeyer | 126/539 |
| 4,135,488 | * | 1/1979 | Wells | 126/531 |
| 4,385,622 | * | 5/1983 | Tidwell | 126/531 |
| 4,527,541 | * | 7/1985 | Roberts | 126/500 |
| 4,584,986 | * | 4/1986 | Cannata | 126/500 |
| 4,681,087 | * | 7/1987 | Meeker | 126/77 |

OTHER PUBLICATIONS

FireSpaces, Inc., Moberg MRC Fireplaces, pp. 1–3, published at least prior to Mar. 2, 1999.

* cited by examiner

*Primary Examiner*—James C. Yeung
(74) *Attorney, Agent, or Firm*—Chernoff, Vilhauer, McClung & Stenzel

(57) ABSTRACT

A fireplace assembly comprises a smoke chamber and a firebox in fluid communication with the smoke chamber. A masonry casing partially surrounds the firebox, the casing having a pair of spaced-apart side walls which together define an opening to the firebox. In one aspect of the invention, a lintel supports at least one chimney breast block across the opening, the lintel extending between the side walls and being supported by the side walls. In another aspect of the invention, a damper is mounted above the smoke chamber. In another aspect of the invention, the firebox is comprised of a plurality of firebrick, a metal firebox frame for guiding installation of the firebrick, and insulation between the firebox frame and the firebrick. In yet another aspect of the invention, insulation surrounds the back and sidewalls of the firebox and smoke chamber.

7 Claims, 6 Drawing Sheets

FIREPLACE ASSEMBLY

BACKGROUND OF THE INVENTION

The present invention relates to a fireplace assembly, and more particularly to masonry fireplaces.

Masonry fireplaces are well known and have been used for years. Such fireplaces are often preferred over metal wood stoves or metal fireplaces for their aesthetic qualities. However, traditional masonry fireplaces have suffered from several drawbacks. Principal among these drawbacks is that masonry fireplaces often provide inefficient and incomplete combustion, resulting in high levels of air pollution, especially in the form of particulates. This drawback has led some municipalities to ban masonry fireplaces. Yet another drawback of traditional masonry fireplaces is that they often fail to provide adequate ventilation, resulting in smoke exiting the fireplace not through the chimney, but instead "spilling" smoke through the front opening of the firebox.

Another problem with the construction of traditional masonry fireplaces has been that, in general, most masons are unfamiliar with efficient and aerodynamically effective fireplace designs. It has been known for some time that particular fireplace designs, such as the Rumford fireplace design, can provide for more efficient combustion. Unfortunately, the Rumford design requires particular geometries, which include a curved lintel and specific firewall geometry from the bottom of the firebox to the smoke chamber. In addition, the geometry of the smoke chamber, damper, and throat are critical to efficient Rumford fireplace operation. However, even for masons who are familiar with efficient fireplace designs, these particular designs are difficult for most masons to create using only mortar and brick because of the complex non-rectangular geometries that are necessary to achieve these designs.

Some attempts have been made to provide masons with forms to guide construction of functional and efficient masonry fireplaces, but these forms have not been well received. Masons have typically resisted the incorporation of metal forms into masonry fireplaces, mainly because they are accustomed to using the tools and materials of masonry construction, and because they are unaware of the limitations of the strength of masonry. More fundamentally, the expansion of metal within a fireplace may cause the surrounding masonry to crack because of the different degrees and rates of heat expansion between masonry and metal.

Another solution to guide construction of fireplaces has been to provide preformed masonry blocks that when assembled form a fireplace. However, such materials are heavy and expensive to ship and transport compared to the great volumes of materials still available locally.

One such attempt to provide a "kit" is supplied by Superior Clay of Ohio and is made almost exclusively out of extruded clay tiles in various shapes. Although this kit does not provide forms for firebox construction, it does have a single-size chimney breast tile laid on its side and strung on a simple steel angle to form an opening. This design has several drawbacks. Extruded clay tiles are appropriate in compression, as in chimney flues, but not in suspension. Over time the tiles may crack and break down. In addition, the mason must make a difficult cut into the surrounding masonry casing to fit the lintel into the right position. The kits also use very heavy clay tiles to form a variety of smoke chambers—some of which are asymmetrical and result in poor performance. The kit also uses a metal damper placed at the throat and the whole system forms a very shallow "traditional" style Rumford fireplace with interior hearths less than 16" deep. This system requires consumers to develop new and unfamiliar firing techniques such as "teepee" firing. Most operators, however, install gratings and suffer with its lack of performance, such as dirty-burning and smoke-spilling operations.

Accordingly, what is therefore needed is a fireplace assembly that allows construction of an efficient wood burning masonry fireplace, that provides for good fuel combustion with little resulting pollution, that allows masons to construct such fireplaces quickly and easily primarily with material on hand, that provides forms for the construction of difficult and precise geometries, that does not result in cracking of the masonry due to different expansion rates of the constituent materials of the fireplace assembly, that uses light-weight durable materials for the forming of geometries, and that allows operators to use traditional wood-burning methods.

SUMMARY OF THE INVENTION

The present invention overcomes the aforesaid drawbacks of the prior art by providing in a first aspect a fireplace assembly comprising a smoke chamber and a firebox in fluid communication with the smoke chamber. A masonry casing sits adjacent to the firebox, the casing having a pair of spaced apart side walls which together define an opening to the firebox. A lintel supports at least one chimney breast block across the opening, the lintel extending between the pair of side walls and being supported by the side walls.

In a second aspect of the invention, a masonry fireplace assembly comprises a smoke chamber and a firebox in fluid communication with the smoke chamber. A masonry casing sits adjacent to the firebox, the casing having a pair of spaced apart side walls which together define an opening to the firebox. A damper is mounted above the smoke chamber.

In a third aspect of the invention, a fireplace assembly comprises a smoke chamber and a firebox in fluid communication with the smoke chamber. A masonry casing sits adjacent to the firebox, the casing having a pair of spaced apart side walls which together define an opening to the firebox. The firebox is comprised of a plurality of firebrick, a metal firebox frame for guiding installation of the firebrick, and insulation between the firebox frame and the firebrick.

In a fourth aspect of the invention, a method of constructing a fireplace is provided. A metal firebox frame is formed. At least a major portion of the firebox frame is surrounded with insulation. A plurality of firebrick is placed within the firebox frame to form a firebox. The firebox sits adjacent to a masonry casing, the casing having a pair of spaced apart side walls which together with the firebrick and the firebox frame define an opening to the firebox. A smoke chamber is mounted above the firebox in fluid communication with the firebox.

The various aspects of the present invention have one or more of the following advantages. By providing a lintel to extend across the opening to the firebox to support the chimney breast block, the geometry of the breast and throat of the firebox may be easily and precisely defined by the mason. In addition, the lintel and its support brackets may provide additional reinforcement to the masonry structure and define the ultimate maximum width of the opening of the firebox. The support brackets allow for easy and precise assembly without having to modify the side walls of the masonry casing.

Mounting the damper above the smoke chamber results in an improved draft by allowing the heated gases of the fire to rise relatively unimpeded into the chimney, creating a reduced risk of smoke spillage by inducing the flow of room air into the throat at the top of the firebox opening, and consequently resulting in more trouble-free performance.

By providing a metal firebox frame, the shape of the firebox may be precisely defined, thus allowing even a relatively unskilled mason to construct fireplaces that provide extremely efficient combustion with little pollution. The sloped shape of the rear wall, continuously inclined toward the firebox starting at the base of the wall, also provides advantages for clean burning. By deflecting radiant heat from the fuel load back into the grating, primary combustion temperatures are increased and smoky startup conditions are reduced. This radiant effect also directs more radiant energy into the room without raising the height of the opening to the firebox because of the sloped geometry. Both combustion and heat transfer efficiencies are improved.

In a preferred embodiment, beneath the fuel load, a one-piece basepan assembly forms the exact footprint for all the elements of the fireplace, making construction of the firebox easy and well-defined. This assembly also contains air delivery channels that bring outside air for combustion to the front edge of the opening. Here the air can move naturally and directly into the fuel load, rather than bypassing the fuel load and diluting the chimney temperatures. An air deflector prevents ash buildup and runs clean cool air against a glass door that can optionally be mounted on the fireplace to improve efficiencies. In the assembly, a cutout allows access for a site-built ash dump.

In another preferred embodiment, around the perimeter of the opening, mounted by brackets to the lintel above and by connection to the base pan below, a door (or screen) mounting frame clearly sets the height of the opening and controls the mason's construction of the firebox. This frame tucks neatly behind any finish facing and facilitates firmly mounting doors without the necessity of anchoring bolts into the facing or the firebrick. Permanent, durable and air-controlling doors become an easy option.

Finally, the use of insulation between the metal surfaces of the respective components of the fireplace assembly and the surrounding masonry allows the metal and masonry to expand at different rates and different amounts, thus substantially decreasing the possibility that the masonry will crack as a result of the increased expansion rate of the metal components. Insulation installed around the metal firebox frame and smoke chamber also provides advantages for clean burning. By reducing heat flow into the surrounding masonry casing, insulation builds up temperatures in the firebox and forces more heat towards the room side. These higher firebox temperatures result in cleaner, hotter-burning fires and reduced pollution.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
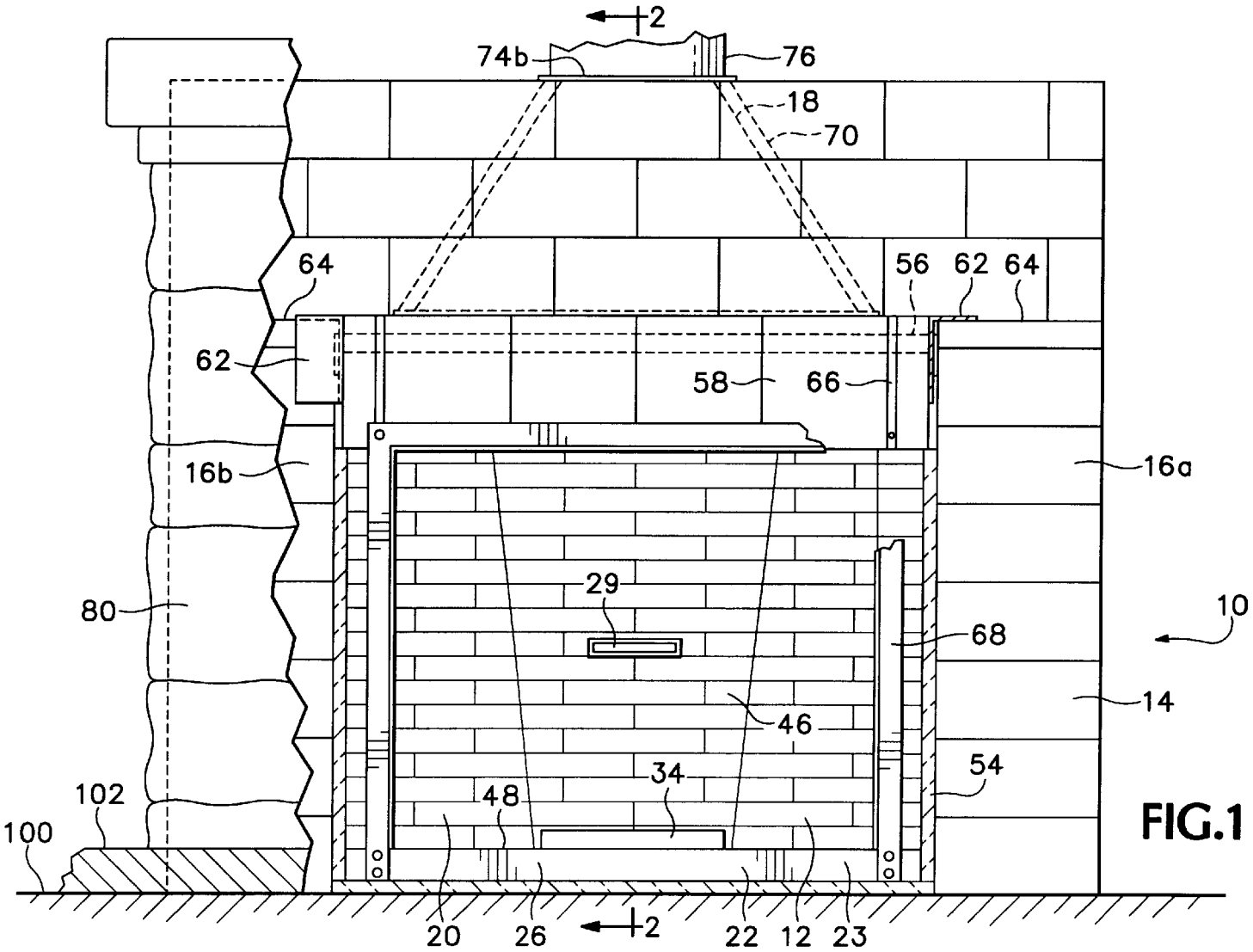
FIG. 1 is a partial cutaway front view of an exemplary fireplace constructed according to the present invention, showing several of the elements in cross section or phantom view.

Referring now to the figures, wherein like numerals refer to like elements, the present invention provides a fireplace assembly and a method for constructing a masonry fireplace. In one embodiment, the fireplace 10 has a firebox 12 surrounded by a masonry casing 14. The masonry casing 14 has a pair of sidewalls 16*a* and 16*b* that together define a front opening 15 to the firebox 12. The fireplace 10 also includes a smoke chamber 18 in fluid communication with the firebox 12. The various aspects of the present invention relating to the fireplace 10 may be used singly or collectively in the construction of masonry fireplaces, but most preferably collectively.

Figure 2:
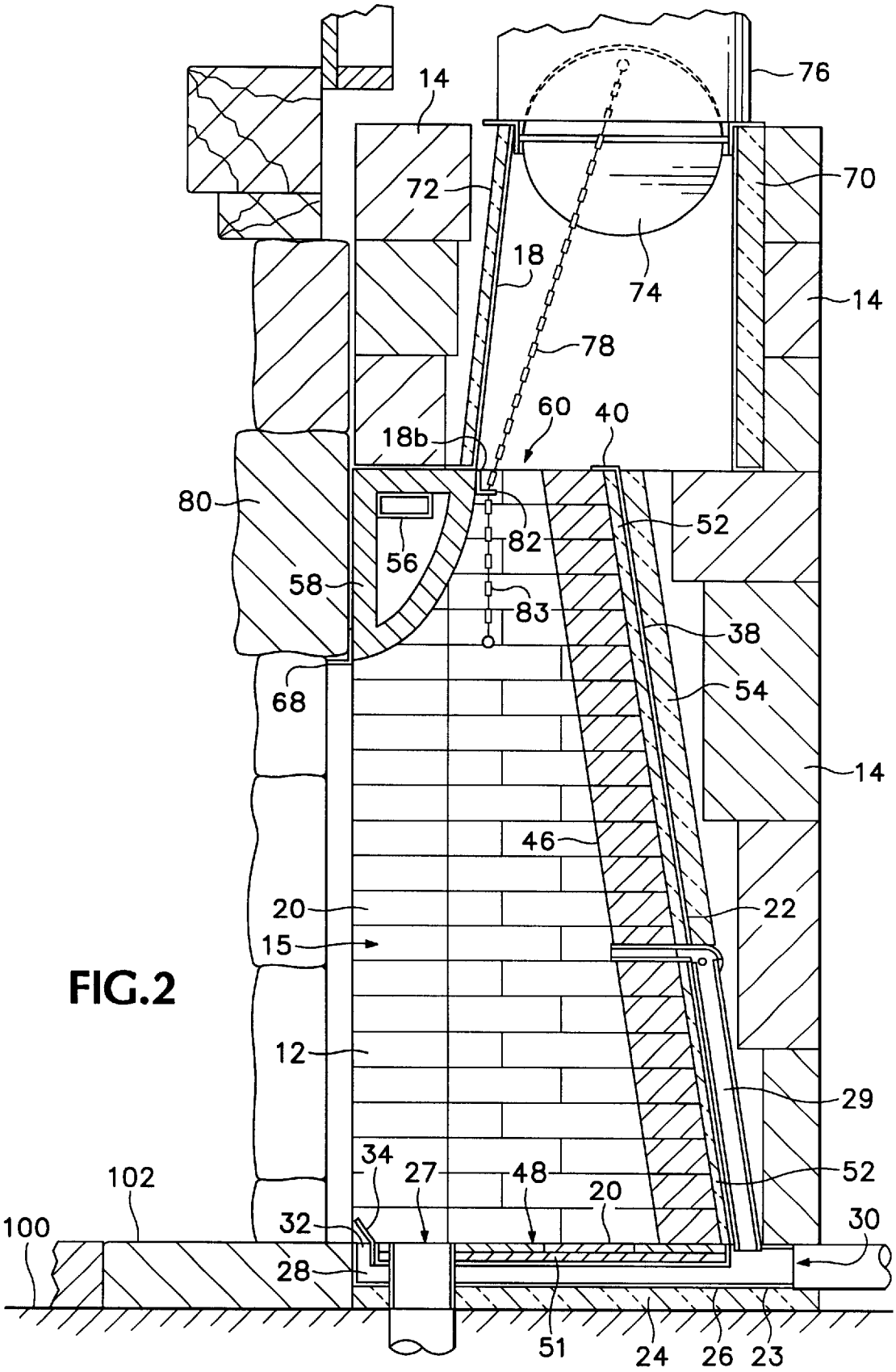
FIG. 2 is a cross-sectional view taken along line 2—2 of FIG. 1.
Figure 3:
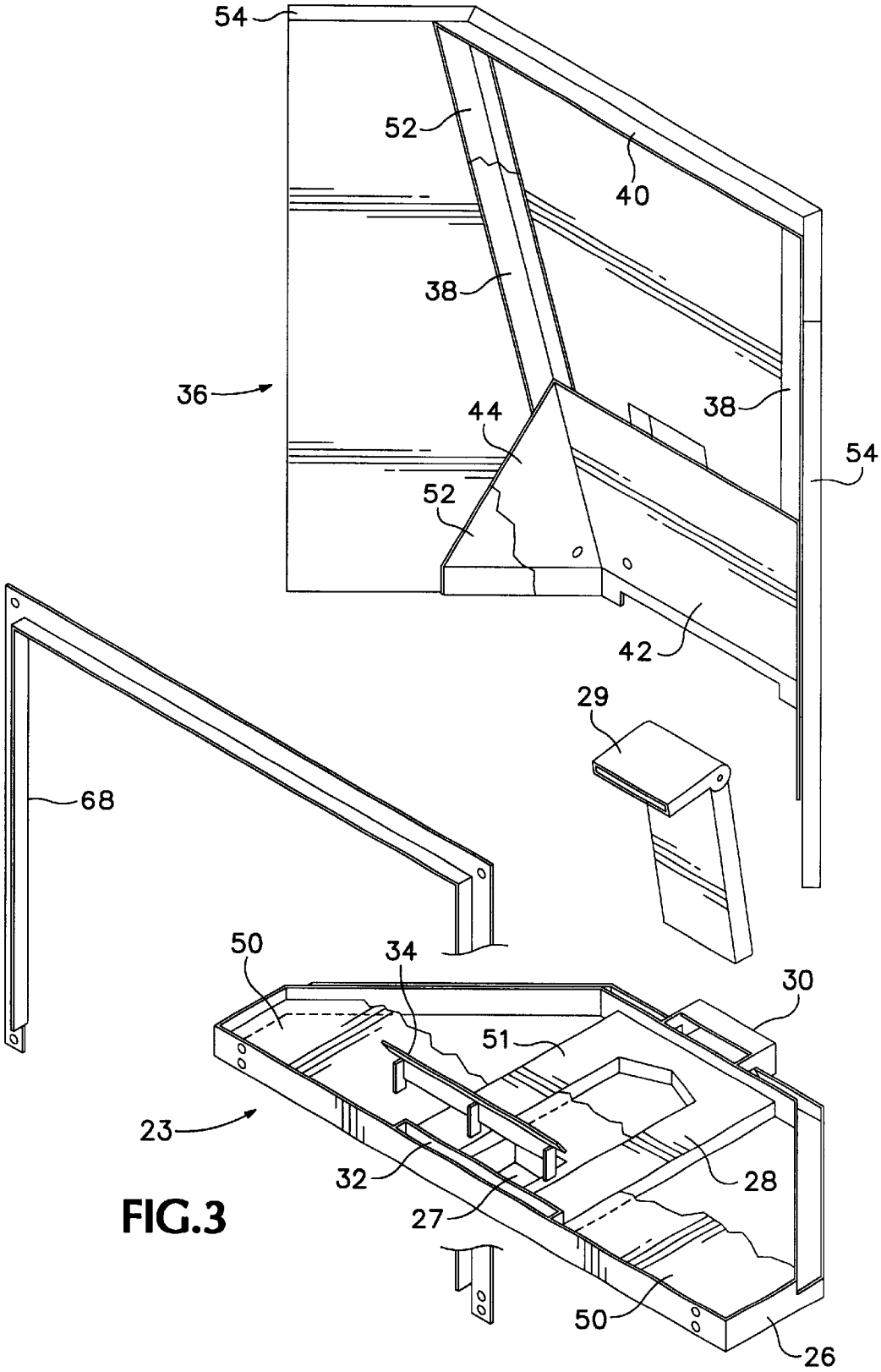
FIG. 3 is an exploded assembly view of an exemplary firebox frame, air duct and door frame of the present invention.
Figure 4:
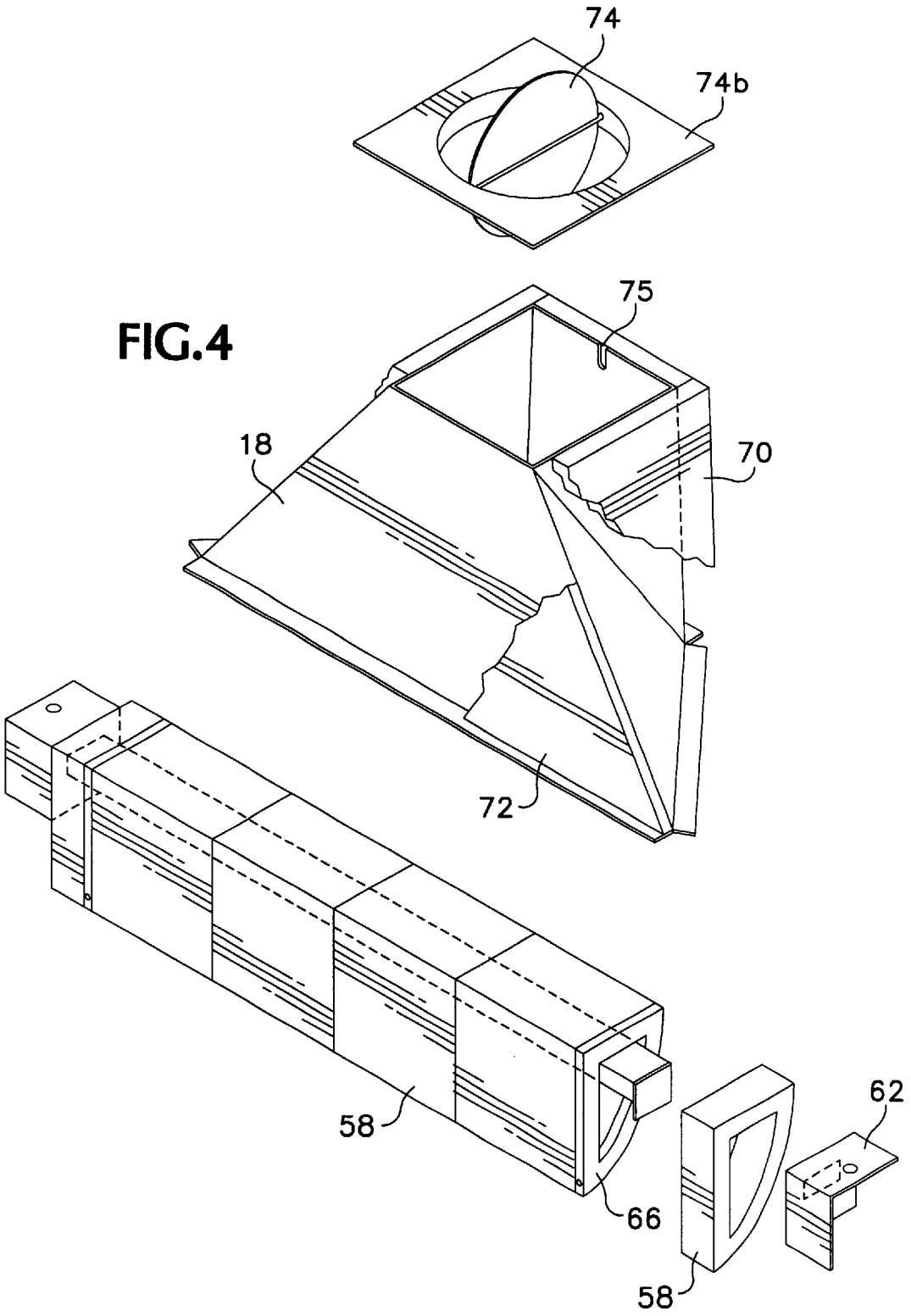
FIG. 4 is an exploded assembly view of an exemplary damper, smoke chamber and lintel of the present invention.
Figure 5:
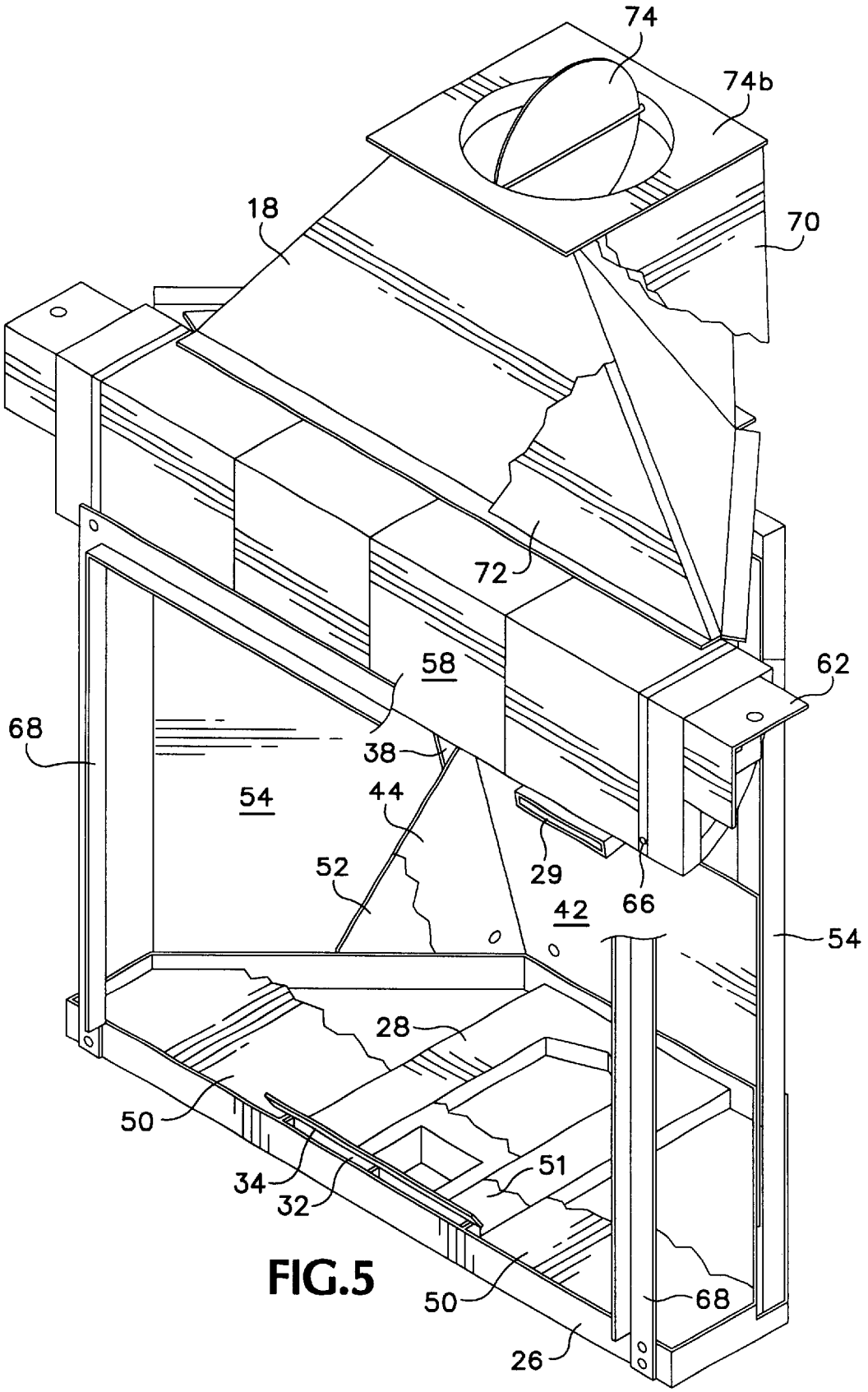
FIG. 5 shows a perspective view of an assembled fireplace assembly with most of the surrounding masonry removed.

One aspect of the invention is directed toward the construction of the firebox 12. Referring now especially to FIGS. 1–3, the firebox 12 is comprised of at least a plurality of firebrick 20, a metal firebox frame 22, and one or more layers of insulation. As shown most clearly in FIG. 3, the metal firebox frame 22 is further comprised of several pieces. The bottom portion 23 of the metal firebox frame 22 includes a metal base pan 26. The metal base pan defines the base layout for the firebox, thus establishing the perimeter of the bottom of the firebox and location of firebrick. The metal base pan 26 optionally defines an opening 27 for an optional conventional ash dump near the opening of the firebox. The metal base pan 26 further includes a primary air duct 28 that has at one end an external air inlet 30 that may be connected to an external source of air to be supplied to the firebox 12. The front end of the primary air duct 28 is an air outlet 32 in fluid communication with the firebox. Deflector 34 deflects air up and into the firebox 12 and against the (optional) front doors (not shown) as will be explained later. It also prevents ashes from entering the primary air duct. An (optional) secondary air duct 29 is in fluid communication with the air inlet 30 and also supplies air into the firebox 12. Both the primary air duct 28 and secondary air duct 29 improve efficiency of combustion by supplying air directly into the firebox 12 near the fuel source. They especially allow efficient operation when front doors close the front opening 15 (due to increased firebox pressures and increased air flow in the air ducts). The frame may also include holes to allow plumbing for gas lines into the fireplace.

The metal firebox frame 22 further includes an upper portion 36 which consists of a pair of substantially upright rails 38 which are connected at the top by a horizontal top rail 40. The upper portion 36 also includes a rear wall 42 and a pair of side walls 44. In use, the metal firebox frame 22 guides installation of the firebrick 20 to form the precise geometry necessary for the firebox 12. Firebrick are laid into the base portion and built up to form the walls of the firebox. In the embodiment depicted in the figures of the present invention, a Rumford style firebox is shown. Rumford style fireboxes are known to be highly efficient fireplaces. In such fireplaces, the side walls 44 are at a 45° angle relative to the rear wall 42. In addition, the frame preferably provides that the rear wall of the firebox 46 inclines at a substantially uniform angle of about 8.5° from the bottom 48 of the firebox to the smoke chamber 18. This particular geometry results in improved efficiency over traditional Rumford fireboxes due to the increased reflection of heat from the rear wall 46 and side walls back into the fuel load, which rests on the bottom 48 of the firebox. The walls also reflect heat through the front opening 15 of the firebox 12 into the adjacent room. While particular angles have been described, the invention encompasses other geometries as well.

When metal components are used to construct the fireplace 10 of the present invention, and in particular when metal components are used to construct the firebox frame 22, it is necessary to include insulating material between the metal components and the surrounding masonry. Accordingly, the present invention provides insulation between metal surfaces of the firebox frame 22 and the surrounding masonry casing 14 and firebrick 20. Insulation 50 such as structural glass board may also be used to fill the bottom portion of the base pan 26. Insulation in the form of a thin layer of high-temperature fiber expansion gasketing 51 is interposed between the primary air ducts 28 and the overlying firebrick 20 in the bottom 48 of the firebox. The expansion gasketing may be, for example, clay wool, mineral wool or ceramic wool in thicknesses of at least ⅛". The expansion gasketing may be adhered directly to the metal surfaces of the firebox frame 22,-or may be held in place simply by the surrounding masonry itself. In addition, a thin layer of expansion gasketing 52 is interposed between the metal surfaces of the upper portion of the firebox frame 22 and the firebrick 20 in the upper portion of the firebox 12. Thus, the inward facing surfaces of the rails 38, top rail 40, rear wall 42 and side walls 44 are similarly covered with a layer of expansion gasketing 52 to prevent direct contact between the metal surfaces of the frame 22 and the firebrick 20.

Surrounding the outside of the firebox frame 22 is a thicker layer of insulation 54 consisting of at least ½"-thick high-temperature fiber wool or fiberboards. The use of insulation behind the firebox frame 22 similarly protects the surrounding masonry casing 14 from expansion of the metal components of the firebox frame 22, and in addition increases the temperatures within the firebox, thus increasing combustion efficiency within the firebox. Other thicknesses and insulating materials may be used to surround the metal frame 22 to prevent contact and provide insulation between the metal surfaces of firebox frame 22 and the surrounding masonry.

In another aspect of the invention, a lintel 56 is provided to support the chimney breast. The lintel 56 extends above and across the opening 15 to the firebox 12. The lintel 56 is preferably made of steel or other rigid material capable of supporting heavy loads, such as masonry blocks. In the embodiment depicted in the figures, the lintel is comprised of a hollow tubular piece of steel. The lintel 56 supports at least one chimney breast fireblock 58. Preferably, each of the chimney breast fireblock 58 is a hollow block made from refractory cement and fire proof aggregates. The refractory cement is reinforced with high-temperature stainless steel and/or wool fibers. These fireblocks may also be filled with insulation to slow heat transfer to the front facing. This way, the cement blocks can hang in front of the firebox and sustain the inevitable expansion and contraction without distorting or dropping pieces into the firebox. By hanging the breast block on the metal lintel, the structural metal lintel is removed from the direct radiant heat of the fire and protected from more extreme expansion rates. In the preferred embodiment depicted in the figures, the chimney breast fireblock 58 have an inwardly-facing curved surface directed toward the interior of the firebox 12. This particular geometry is another feature of the Rumford fireplace. The inward curve of the chimney breast fireblock 58 provides for improved draw of room air along the heated surface of the chimney breast fireblock 58 into the throat 60 of the fireplace 10.

The lintel 56 is supported across the opening 15 to the firebox 12 by the two side walls 16a and 16b of the masonry casing 14. Each end of the lintel 56 is connected to a bracket 62 which is supported by the top surface 64 of each side wall 16*a* and 16*b*. The bracket 62 may be further secured by bolts or seismic rebar to the side walls 16*a* and 16*b* so as to provide additional reinforcement to the masonry fireplace. The brackets provide an advantage in that the brackets allow easy installation of the lintel 56 and chimney breast fireblock 58. Because the brackets are supported by the upper surface 64 of the side walls 16a and 16b, the lintels 56 may be installed by simply lifting the lintel 56 and supported chimney breast fireblock 58 up into position and resting the brackets 58 on the upper surface 64. This eliminates the need to engage in complicated cutting of masonry to provide supports for the lintel 56 or chimney breast.

In another aspect of the invention, the lintel 56 supports a pair of door mounting frame plates 66. Each of the door mounting frame plates 66 is securely mounted to the chimney breast which in turn is supported by the lintel 56. Each of the door mounting frame plates 66 is hollow and allows placement that is controlled by the chimney breast blocks. A door mounting frame 68 surrounds the opening 15 to the firebox 12 and is secured at the bottom of the frame 68 to the base pan 26 and at the top of the frame 68 to each of the door mounting frame plates 66. The use of the door mounting frame plates 66 together with the door frame 68 allows for quick and easy installation of front doors and/or screens after the masonry facing 80 has been completed. When glass front doors are installed within the door mounting frame 68, the primary air duct 28 and deflector 34 together keep the doors clean by providing a flow of clean air against the glass doors which in turn feeds the fire within the firebox 12.

The use of the lintel 56 to create the chimney breast has a further advantage in that it allows precise construction of the throat 60. The rear edge of the throat 60 is defined by the firebrick 20 within the firebox 12, which has been guided into position by the rails 38 and 40 of the metal firebox frame 22. To provide for a good draft within the firebox 12, the distance between the back of the throat 60 and front portion of the throat defined by the chimney breast should be within certain limits in order to optimize operations. The use of the lintel 56 in combination with the chimney breast fireblock 58 allows fine adjustment of the dimension of the throat 60 by carefully positioning the lintel 56 with respect to the side walls 16*a* and 16*b*. Thus, even unskilled masons, by using the firebox frame 22 and the lintel 56 of the present invention, can define the precise geometries necessary for the throat 60 of a highly functional and efficient fireplace.

In another aspect of the invention, a smoke chamber 18 is placed on top of the firebox 12 and is in fluid communication with the firebox 12 and the chimney flue 76. The fireplace 10 of the present invention may be used with any standard and approved metal or masonry chimney flue 76 that meets the minimum cross-sectional requirements of the fireplace. Preferably, the smoke chamber 18 is configured so that only a portion of the smoke chamber 18 is directly above the throat 60 and the front plane of the smoke chamber 18 is aligned with the back plane of the chimney breast 58. A guiding flange 18*b* (shown in FIG. 2) can facilitate this alignment. Smoke chamber 18 should be large enough to provide adequate ventilation for the firebox 12. The smoke chamber must allow for a transition from the planar flow of gases from the firebox to the circular flow generated in square and round chimney flues. Side walls should slope at no more than 45° off vertical and, ideally, no more than 30° off vertical for larger fireboxes. The smoke chamber 18 is preferably constructed of a heavy gauge steel of about ⅛" or more thickness. When a metal smoke chamber 18 is used, insulation must be interposed between the surrounding masonry and the metal surface of the smoke chamber 18. In the embodiment depicted in the figures, insulation 70 consisting of 2" thick fiberboard surrounds the smoke chamber 18 on the back and two sides. On the front side of the smoke chamber 18, insulation consisting of expansion gasketing 72 is interposed between the metal surface of the smoke chamber and the masonry casing 14. The use of a prefabricated metal smoke chamber 18 provides yet another advantage to the mason. The smoke chamber 18 may be prefabricated in a shape that provides a more efficient draw and, hence, more efficient combustion within the firebox 12. Thus, the mason is relieved of the task of precisely forming such a complicated shape using only brick and mortar. In particular, the smooth, clean lines of the metal smoke chamber 18 provide improved aerodynamic efficiency compared to the rough, staggered interior surfaces of a traditional masonry smoke chamber.

In another aspect of the invention, a damper 74 is provided on top of the smoke chamber 18. Preferably, the damper 74 is a butterfly damper as depicted in the figures. Placing the damper 74 on the top of the smoke chamber 18 further improves the efficiency of the fireplace 10 by improving the draw of air. Orientation of the damper and smoke chamber is determined by a slot 75 in the smoke chamber which receives a projection on the damper. The damper 74 may be controlled by a damper cable 78, which extends down into the firebox 12 for easy access. A stop bracket 82 is used to guide the damper cable 78 and to secure the damper 74 open or closed at the top of the smoke chamber. A counterweight can assure that the damper falls open when the cable is released, and a stop handle 83 assures that the cable is contained below the stop bracket 82.

Figure 6:
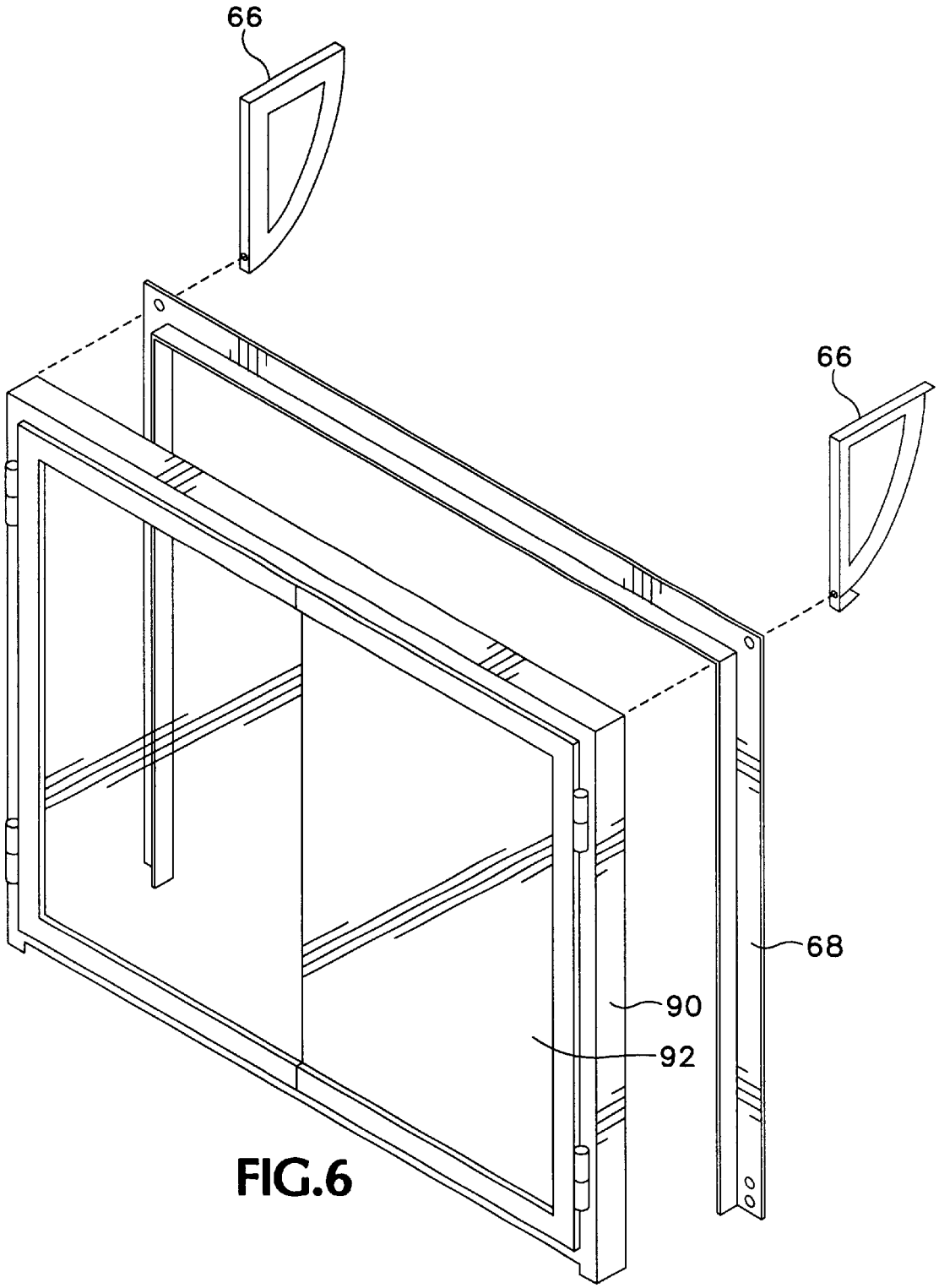
FIG. 6 shows a perspective view of a door frame and optional doors.

To construct the fireplace 10 of the present invention, underlayment for the base pan 26 is first prepared by providing either masonry and/or insulation 24 under the base pan 26 to adjust it to a desired height. FIGS. 1 and 2 show the firebox resting on subflooring 100 and being raised so that the bottom of the finished firebox is at the same level as floor 102. The metal firebox frame 22 is then assembled, and insulation provided on the external surfaces. Expansion gasketing is placed on any exposed metal surface which will be adjacent to any masonry or firebrick to prevent direct contact. The masonry casing 14 is then constructed around the metal firebox frame 22. The masonry casing 14 may be constructed of any locally available concrete or masonry material, such as cement block or brick masonry. Gaps within hollow block are preferably filled with mortar, and as necessary to meet minimum code thickness for solid masonry construction and for seismic reinforcements. After the masonry casing 14 has been built up to the level of the top of the firebox 12, the chimney breast is installed by extending the lintel 56 across the pair of side walls 16*a* and 16*b*. The lintel 56 includes the chimney breast fireblock 58 and door frame mounting plates 66. The smoke chamber 18 is then mounted on top of the chimney breast and firebox 12. Expansion gasketing is placed along the front surface of the smoke chamber 18 and insulation is placed around the remaining three sides of the smoke chamber 18. The masonry casing 14 is continued to be built up around smoke chamber 18. Again, spaces within any hollow block and around frame 74*b* are filled with mortar. The damper 74 is mounted on top of the smoke chamber 18, followed by connection to a chimney flue 76. The firebox 12 is formed by laying firebrick 20 within the metal firebox frame 22 (and may optionally be built just prior to installing the chimney breast). The door mounting frame 68 is then mounted to the base pan 26 and the door mounting frame plates 66. External masonry facing 80 may then be applied to the front portion of the masonry casing 14 to provide the desired facing and mantle. Optional front doors 92 (shown in FIG. 6) may then be installed by attaching a door frame 90 to the door mounting frame 68. The masonry casing 14 may also be constructed as a finished facing for the sides and rear of an exposed fireplace.

While one particularly efficient fireplace geometry has been shown and described, it will be apparent to one skilled in the art that the various aspects of the present invention may be used to construct fireplaces of varied shapes and dimensions.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A fireplace assembly, comprising:

(a) a smoke chamber;

(b) a firebox in fluid communication with said smoke chamber;

(c) a masonry casing adjacent to said firebox, said casing having a pair of spaced apart side walls which together define an opening to said firebox; and (d) a lintel supporting at least one chimney breast block above said opening, said lintel extending between said pair of side walls and being supported by said side walls.

2. The fireplace assembly of claim 1 wherein said chimney breast block is of reinforced refractory cement.

3. The fireplace assembly of claim 1 wherein said chimney breast block has a curved portion facing inward toward said firebox.

4. The fireplace assembly of claim 1 further comprising a pair of door frame mounting plates supported by said lintel.

5. The fireplace assembly of claim 1 wherein said chimney breast block is hollow and said lintel extends through said chimney breast block.

6. The fireplace assembly of claim 1 wherein said firebox comprises a metal firebox frame, a plurality of firebricks, and insulation between said metal firebox frame and said firebricks.

7. A method for constructing a fireplace, comprising:

(a) forming a metal firebox frame;

(b) surrounding at least a major portion of said firebox frame with insulation;

(c) placing firebrick within said firebox frame to form a firebox, said firebrick being free from direct contact with said firebox frame;

(d) partially surrounding said firebox frame with a masonry casing, said casing having a pair of spaced apart side walls which together define an opening to said firebox;

(e) mounting a smoke chamber above said firebox and in fluid communication with said firebox; and (f) supporting at least one chimney breast block from said lintel.

* * * * *